United States Patent [19]

Masuda et al.

[11] 4,157,743

[45] Jun. 12, 1979

[54] WORKING BASE ELEVATING APPARATUS

[75] Inventors: Akira Masuda, Matsudo; Takahiro Enoki, Zushi; Toshifumi Kobori, Funabushi, all of Japan

[73] Assignee: Nisso Sangyo Co. Ltd., Japan

[21] Appl. No.: 853,299

[22] Filed: Nov. 21, 1977

Related U.S. Application Data

[63] Continuation of Ser. No. 686,150, May 13, 1976, abandoned.

[30] Foreign Application Priority Data

May 15, 1975 [JP] Japan ..... 50-66363
Sep. 12, 1975 [JP] Japan ..... 50-125659

[51] Int. Cl.[2] ..... E04G 1/22
[52] U.S. Cl. ..... 182/141; 187/18
[58] Field of Search ..... 187/1 R, 8.71, 8.72, 187/17, 18; 52/109; 74/521; 108/145; 182/63, 141, 148; 254/122

[56] References Cited

U.S. PATENT DOCUMENTS

| | | | |
|---|---|---|---|
| 1,498,813 | 6/1924 | Sankela et al. | 187/18 |
| 1,931,997 | 10/1933 | Schmidt | 187/17 X |
| 3,341,042 | 9/1967 | Carder | 182/148 |
| 3,498,415 | 3/1970 | Wright | 187/17 |

*Primary Examiner*—Evon C. Blunk
*Assistant Examiner*—James L. Rowland
*Attorney, Agent, or Firm*—McGlew and Tuttle

[57] ABSTRACT

One or more pantographs are connected below a working base and are connected with a main cylinder horizontal or inclined in respect to a supporting base so as to be driven to be extended or contracted. One or more comparatively short auxiliary telescopic cylinders are erected below the working base. During the initial phase of upward movement of the working base the auxiliary cylinders will act directly to push up the working base and, when it has been elevated to a predetermined height, the pushing force is shifted to the main cylinder so that the working base may be further elevated through the pantographs.

When the working base is lowered, the pantographs and main cylinder will be compactly folded.

4 Claims, 13 Drawing Figures

WORKING BASE ELEVATING APPARATUS

This is a streamline continuation of application Ser. No. 686,150 filed May 13, 1976 now abandoned.

INVENTIVE BACKGROUND

This invention relates to working base elevating apparatus and more particularly a new and useful working base elevating apparatus wherein a working base is moved vertically by driving pantographs with an oil pressure device.

Generally, in the building and repairing ships and in such civil engineering works as constructing buildings, tunnels and roads, when the working position is considerably high above the ground surface, scaffolds will be set in this working position so that workers may walk or working machines may be operated on the scaffolds.

In such case, the height of the working position is so different that, to vary the positions of such scaffolds, there has been recently developed a working base elevating apparatus called a lifter wherein a working base is provided with pantographs which are driven by an oil pressure cylinder so as to be vertically extended and contracted to properly adjust the height of the working base in response to the height of the working position. However, in this conventional elevating apparatus, the oil pressure cylinder is fitted in an inclined position and therefore the contracting stroke of the pantograph is limited. Thus the elevating apparatus can not be compactly folded. In such works as welding within a hull block and works within a tunnel, unless the working machines and scaffolds are moved in turn through small clearances, the workability will be low. The above mentioned conventional lifter can not be compactly contracted, and therefore the working base and pantograph collide with the inside walls and the lifter can not be moved through such small clearances.

In order to compactly fold the pantograph, the oil pressure cylinder fitted to it may be made horizontal or may be inclined at a small angle of inclination. However, ever, if the oil pressure cylinder is horizontal or is inclined at a small angle of inclination, the vertical component of force necessary to push up the working base can not be applied since the horizontal component of the force is so large as to be likely to be a cause of breaking the pantograph.

Therefore, such elevating apparatus as in FIGS. 1 to 3 for directly pushing up the working base is considered. In this apparatus, one or more cylinders 11, 11' and 11'' vertical or substantially vertical to the working base 10 are arranged and a pantograph 12 is provided in the middle so that the pushing force may be borne by the cylinders and the partial load and horizontal force may be carried by the pantograph. However, in the elevating apparatus considered in FIGS. 1 and 2, the working base is directly pushed up and therefore the pushing operation is smooth. A disadvantage is that, in order to permit the height of the working base to be sufficient, a cylinder as long as the height is required, and not only it is uneconomical to use a comparatively long cylinder but also, when contracted, the apparatus will not be sufficiently compact.

Further, in a generally already known table lifter, a pantograph is extendably and contractably provided below a working base so as to be driven by a cylinder to vertically move the working base. As this is supported by one pantograph, the stability on the working base is so low that, in case the load touches the end part of the working base, the working base will be likely to incline or tumble and, in case a large load is carried, the apparatus will not be able to be sufficiently driven with one cylinder and the workability will be low.

Therefore, an object of the present invention is to provide a working base elevating apparatus operated by two systems including both an auxiliary telescopic cylinder and a main oil pressure cylinder, and wherein one or more short auxiliary cylinders are arranged below a working base and a horizontal or inclined main oil pressure cylinder is connected to a pantograph so that, at the time of starting of the pushing up of the working base. The auxiliary cylinder may be used to elevate the working base to a height at which the main pressure cylinder is more effective. Thereafter the extending operation is relayed to the main oil pressure cylinder to further raise the pantograph. Thus, the start, the working base may be easily raised with the comparatively small pushing force of the auxiliary cylinder and, at the time of contraction, the working base may be perfectly compactly folded.

Another object of the present invention is to provide a working base elevating apparatus wherein four pantographs are arranged on diagonals below a working base so that the working base may be stable and may be smoothly vertically driven.

A further object of the present invention is to provide a working base elevating apparatus whereby a pantograph and working base are most contracted so as to be flat and to freely run through small clearances in a hull block and to provide a scaffold which can be set speedily so as to improve the working efficiency.

BRIEF EXPLANATION OF THE ILLUSTRATIONS

DETAILED EXPLANATION OF THE INVENTION

Figure 1:
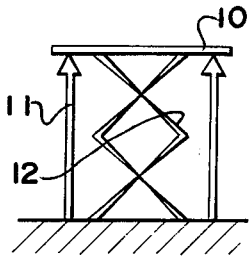
FIGS. 1, 2 and 3 are schematic side views of an elevating apparatus for elevating and lowering a working base directly with cylinders of the prior art.
Figure 2:
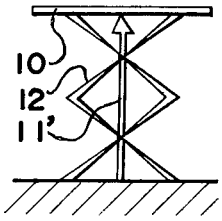
Figure 3:
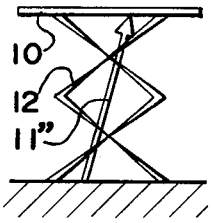
Figure 4:
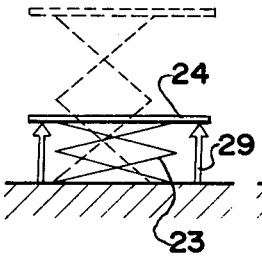
FIGS. 4, 5, 6 and 7 are schematic side views of elevating apparatus using both auxiliary cylinders and main oil pressure cylinders according to the present invention.
Figure 5:
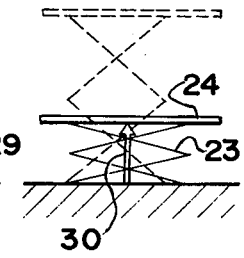
Figure 6:
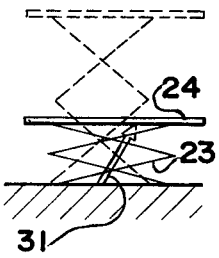
Figure 7:
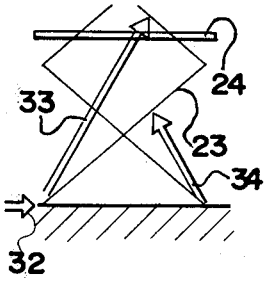
Figure 8:
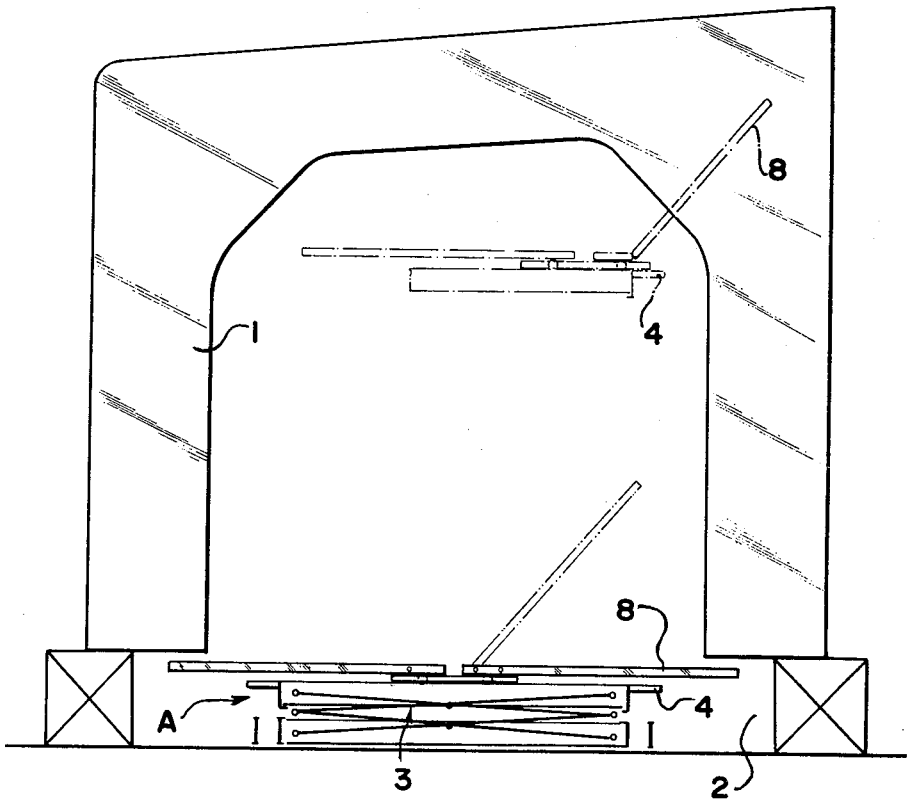
FIG. 8 is a schematic side view showing an embodiment fitted horizontally with a main oil pressure cylinder as being used.

A combination of two systems using an auxiliary and main oil pressure cylinder is shown in FIGS. 4 to 7. That is to say, in FIG. 4, a pantograph 23 is provided below a working base 24 and a comparatively short telescopic or ordinary oil pressure cylinder 29 is arranged in the end part of the working base 24 and is used as an auxiliary cylinder. As shown in FIG. 7, the pantograph is provided with a main oil pressure cylinder 32 in the horizontal direction or a main oil pressure cylinder 33 or 34 fitted as inclined. At the time of starting the apparatus, the auxiliary cylinder 29 will be driven to elevate the working base 24 to any height and then any of the main oil pressure cylinders 32, 33 and 34 will be driven to erect the pantograph.

In the same manner, in the elevating apparatus in FIG. 5, an auxiliary cylinder 30 is erected below the middle of the working base 24 and the pantograph 23 is fitted with the main oil pressure cylinders 32 or 33 and 34 as in FIG. 7.

In the elevating apparatus in FIG. 6, an auxiliary cylinder 31 is fitted as inclined substantially in the middle of the working base 24 and the pantograph 23 is provided with the main oil pressure cylinder 32 or 33 and 34 in such direction as shown in FIG. 7.

In these embodiments, the auxiliary cylinders 29, 30 and 31 are comparatively short to be operated only at the time of starting the elevation of the working base. Therefore, at the time of the contraction, the working base can be made compact. Further, at the time of starting the elevation, the pushing forces of the auxiliary cylinders 29, 30 and 31 will act directly on the working base 24, therefore no large pushing force will be required and the pantograph 23 will be subjected to no pushing force and will not be broken. Further, as the apparatus is started by the auxiliary cylinders 29, 30 and 31, the main oil pressure cylinders 32, 33 and 34 can be horizontal or inclined at a small angle of inclination to the pantograph and, when contracted, the working base will be able to be made compact.

The cylinder may be of an oil pressure or air pressure or of a single moving type or double moving type.

An embodiment in which the main oil pressure cylinder 32 is horizontally fitted to the pantograph 23 and the auxiliary cylinders 29 are arranged in four corners below the working base 24 shall be explained with reference to FIGS. 8 to 11 is the following.

An elevating apparatus A of a preferred embodiment of the present invention is set in a hull block 1. When contracted most, it will be moved in response to the working position through a clearance 2 formed below the hull block 1. When it comes to a fixed working position, a pantograph 3 will be extended to elevate a working base 4 and a ladder 8, provided in the working base 4, will be erected within the hull block.

Figure 9:
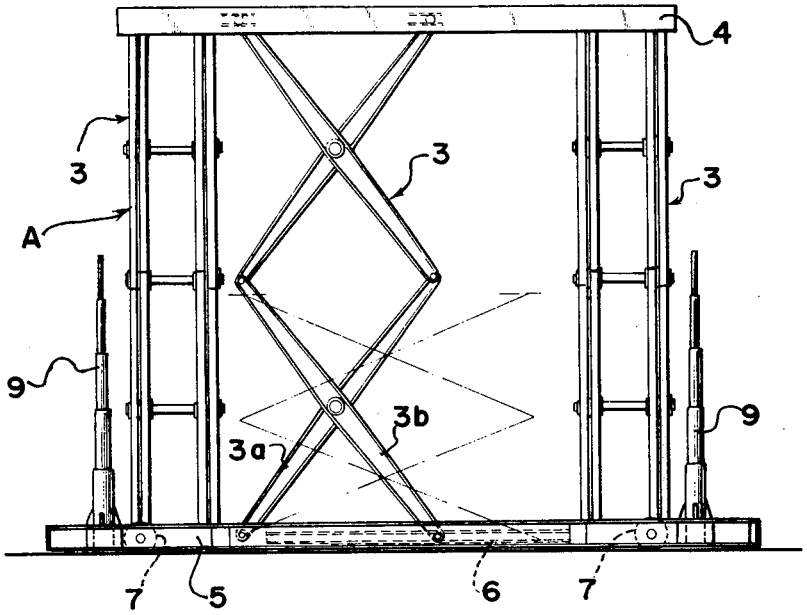
FIG. 9 is a side view of an elevating apparatus of the embodiment fitted horizontally with a main oil pressure cylinder as extended.

In the elevating apparatus A, as shown in FIG. 9, the pantographs 3 are set below the four corners of the working base 4 and are connected at their lower ends with a supporting frame 5 disposed at the lower end of the apparatus. In such case, one leg 3*a* of the two legs 3*a* and 3*b* of the pantograph is pivoted through a bearing or the like to the supporting frame 5 and the other leg 3*b* is fixed to a piston rod of an oil pressure cylinder 6 fitted horizontally within the supporting frame 5 so that, when the leg 3*b* is pushed or pulled in the lateral direction in response to the extension or contraction of the cylinder 6, the pantograph 3 may extend or contract.

Telescopic auxiliary oil pressure cylinders 9 are erected on both sides and ends of the supporting frame 5 and they may be extended upwardly to elevate the working base 4 before the oil pressure cylinder 6 are energized.

The working base 4 is first elevated to a predetermined height by using the auxiliary cylinders 9 to bring the base into the effective range of efficient operation of the main oil pressure cylinder 6. At this time, the extending operation will be relayed to the main oil pressure cylinder 6 to raise the pantograph 3 and working base 4 to the necessary height.

The supporting frame 5 is provided with a plurality of pulleys 7 through which the elevating apparatus A is moved to a fixed working field, or the pantograph 3 is contracted and is moved through the clearance 2 within the hull block 1.

The working base 4 is provided slidably with a plurality of ladders (not illustrated) so that, when the working base 4 is positioned at any height, the ladders may be moved and the workers may carry out such work as welding while rising and lowering on the ladder. However, this working base can be fitted with not only the ladders but also other working devices.

Figure 12:
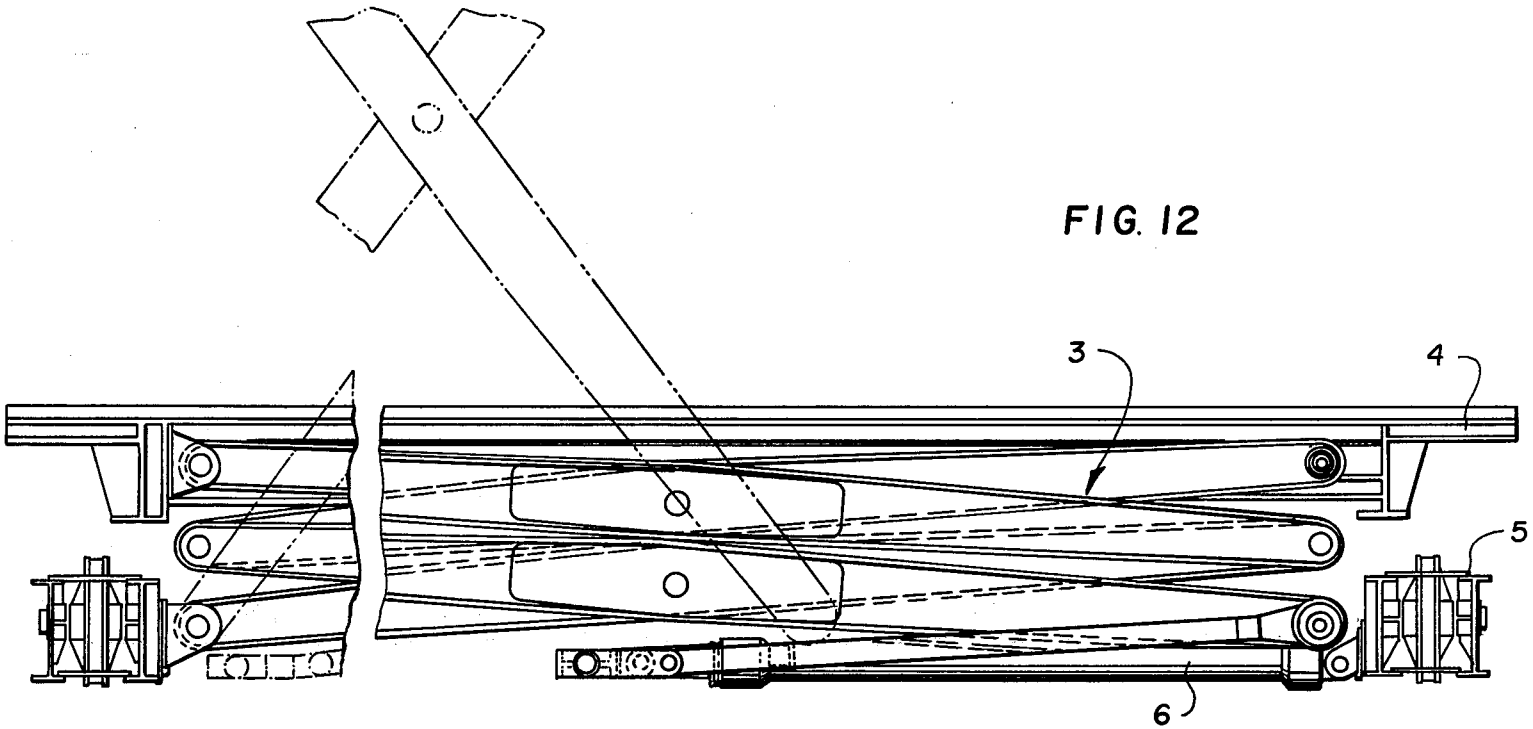
FIG. 12 is a partly sectioned side view of the pantographs of FIG. 9 as contracted.

In the above mentioned apparatus, when the oil pressure cylinder 6 is extended in response to the height of the working position, the leg 3*b* of the pantograph 3 will be pushed in so that the pantograph 3 and working base 4 may rise. At this time, the auxiliary cylinder 9 will be driven to add the elevating force. In case this apparatus A is to be housed, when the oil pressure cylinder 6 is contracted, the leg 3*b* will be pulled to contract the pantograph 3 and working base 4. At this time, the oil pressure cylinder 6 disposed horizontally within the supporting frame 5 will not interfere with the contaracting stroke of the pantograph 3 which will be folded compactly to be substantially horizontal as shown in FIG. 12. Therefore, this elevating apparatus A will be easy to carry, and can be moved through the small clearance 2 (FIG. 8) without the collision of the working base 4. Ladders can be easily mounted on the base 4 so that they will be speedy in the movement and elevating operation and will be remarkably improved in the working efficiency.

Figure 11:
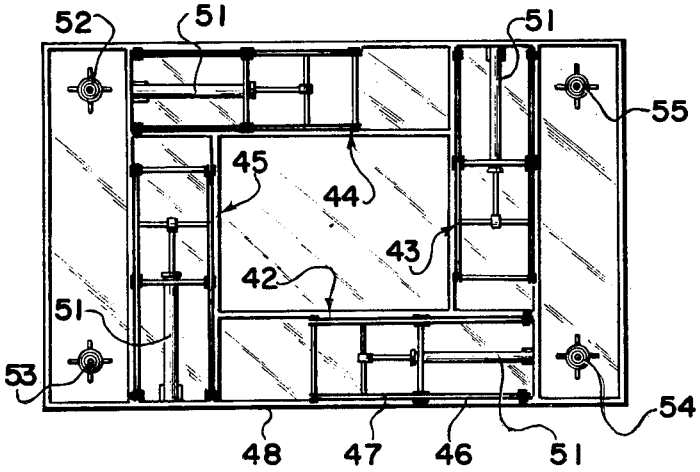
FIG. 11 is a schematic plan view showing the positions of the pantographs of FIG. 10.
Figure 10:
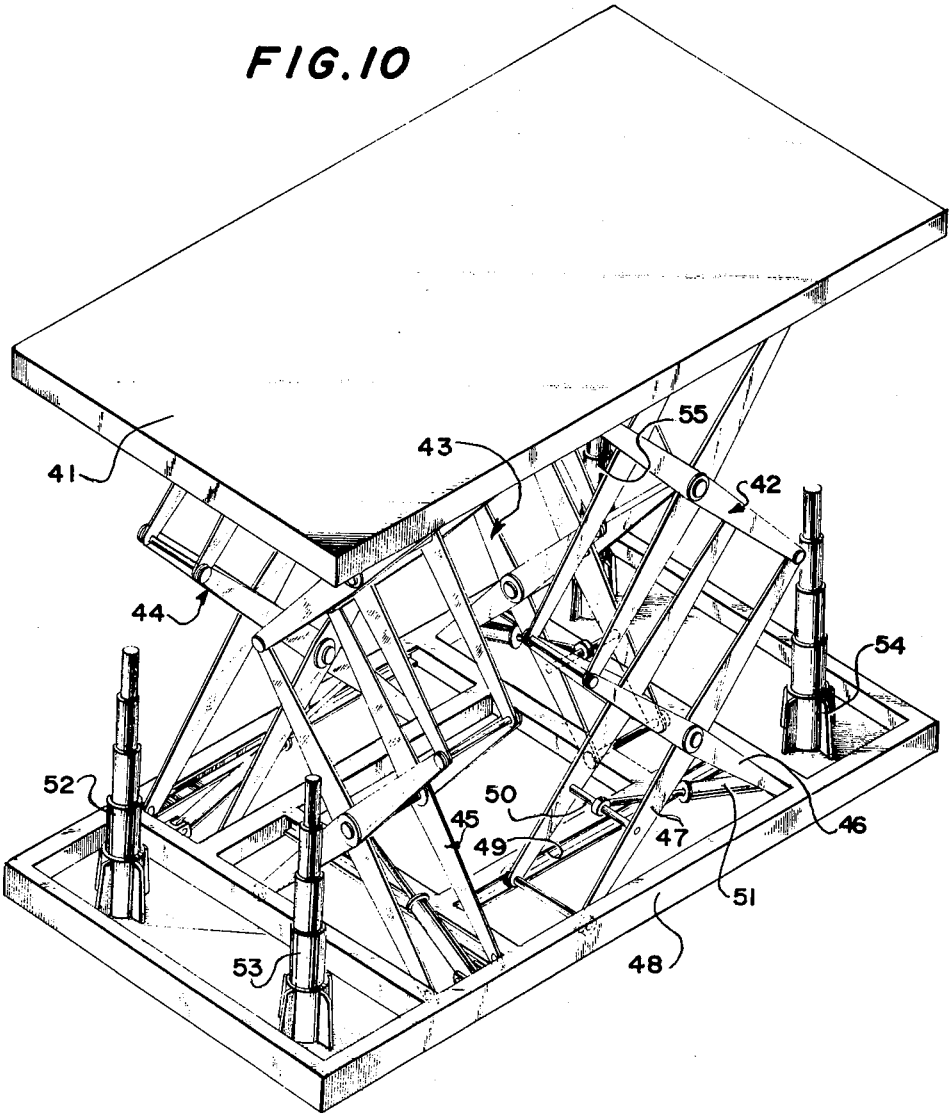
FIG. 10 is a perspective view of a working base elevating apparatus with four pantographs arranged on diagonals.

An embodiment wherein four pantographs are provided in the four corners below a working base and an oil pressure or air pressure cylinder of a comparatively small angle of inclination is fitted to the pantograph shall be explained with reference to FIGS. 10 and 11 in the following.

Four pantographs two transversely operable 43 and 45 and two longitudinally operable 42 and 44, are connected as inclined in the four corners below a working base 41, one leg 46 of each of the pantographs 42, 43, 44 and 45 is fixed at the lower end to a supporting base 48 and the other leg 47 is slidably held in guide means or a guide 49 of the supporting base 48.

A main oil pressure cylinder or respective fluid pressure operated piston and cylinder means 51 is connected between the supporting base 48 and a connecting rod 50 of the leg 47 so that, when this oil pressure cylinder 51 is extended or contracted, each of the pantographs 42, 43, 44 and 45 may move vertically while the leg 47 slides in the guide 49 and the working base 41 may lower or rise.

Auxiliary cylinders or substantially upright fluid pressure operated telescopic members 52, 53, 54 and 55 are erected in the four corners of the supporting base 48 so as to operate to help the extending operations of the main oil pressure cylinders in the pantographs 42, 43, 44 and 45, respectively, when the working base 41 begins to be pushed up.

The auxiliary cylinders 52 and 54 and 53 and 54 are respectively opposed to each other on diagonals below the working base 41. The cylinders 51 are directed in the same direction so as to extend or contract clockwise or anti-clockwise and the working base is supported always by a uniform force.

Therefore, as the working base 41 is always held horizontally by the four auxiliary cylinders 52, 53, 54 and 55, even if a load is applied to the corner of the working base 41, the working base will not incline or tumble. Further, as the working base 41 is driven by the four pantographs so as to rise and fall, it is speedy and stable and is therefore high in the workability and safety.

Figure 13:
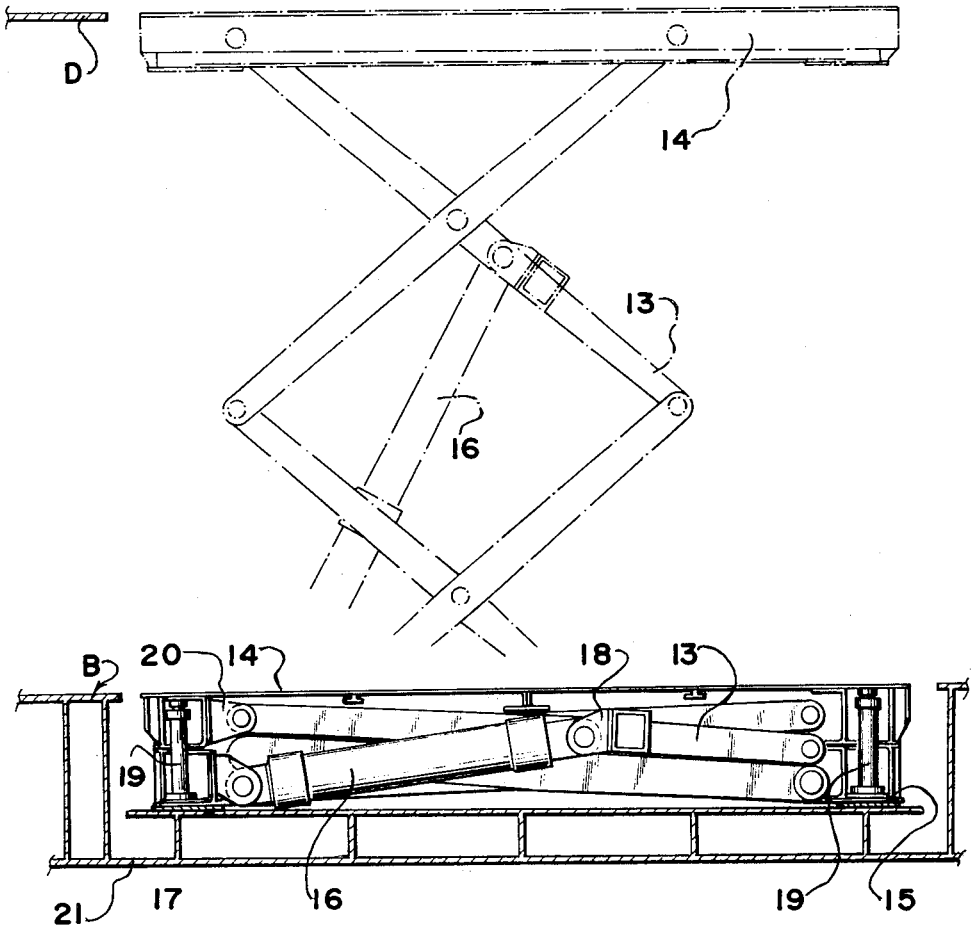
FIG. 13 is a side view of a main oil pressure cylinder as fitted to a pantograph as inclined.

An embodiment wherein a main cylinder is inclined and a ram type oil pressure or air pressure cylinder is used as an auxiliary cylinder and is fitted to a ship bottom shall be described with reference to FIG. 13 in the following.

In this embodiment, a main oil pressure cylinder 16 is pivoted at the base end to a bracket 17 of a supporting frame 15 and at the other end to a pantograph 13 through a bracket 18. The supporting frame 15 is fixed by welding or the like on a supporting base 22 in a ship bottom 21. A ram type auxiliary cylinder 19 is arranged in the supporting frame 15. The pantograph 13 is pivoted to a bracket 20 of a working base 14. When the working base 14 begins to be pushed up, it will be pushed up to any height by using the auxiliary cylinder 19. When it reaches a certain position, the pushing force of the main oil pressure cylinder 16 will act on the pantograph 13 to raise it to the height of a deck D shown by the chain line. At the time of the most contraction, the pantograph 13 will be folded compactly to the position of a floor B of the ship bottom 21. At this time, the main oil pressure cylinder 16 will also incline to be substantially horizontal and therefore the height from the ship bottom 21 to the horizontal sufface of the working base will become very small corresponding to the width of the floor B from the ship bottom 21.

We claim:

1. A scaffold device comprising a rectangular working member, a rectangular support base disposed below said working member, first and second longitudinal guide means adjacent respective sides of said base, first and second transverse guide means adjacent respective ends of said support base, first and second longitudinally operable pantographs pivotally connected between said base and said working member and having first longitudinal leg portions with lower ends pivoted to said base adjacent respective ends of said base and opposite second longitudinal leg portions movable in respective first and second longitudinal guide means, said first and second leg portions being movable longitudinally together to erect said pantograph with said working member and longitudinally apart to lower said pantograph and said working member in respect to said support base, first and second transversely operable pantographs pivotally connected between said working member and said support member and having first transverse leg portions with lower ends pivoted to said base adjacent respective sides of said base and opposite second transverse leg portions movable in respect to first and second transverse guide means, first and second fluid pressure operated longitudinally extendible piston and cylinder means connected between said support base and said second leg portions of respective longitudinally operable first and second pantographs, first and second fluid pressure operated transversely movable piston and cylinder means connected between said support base and said second leg portions of respective transversely operable first and second pantographs, and substantially upright fluid pressure operated telescopic members mounted on said base and being extensible above said base to lift said working member a predetermined initial amount into a position at which all of said piston and cylinder means engage their respective pantograph leg portions so that they are oriented at an angle in respect to the support base above the horizontal, wherein said first and second longitudinally operable pantographs and said first and second transversely operable pantographs are contiguously arranged with said second longitudinal leg portions movable in an area adjacent said first transverse leg portions and said second transverse leg portions movable in an area adjacent said first longitudinal leg portions, such that all of said piston and cylinder means are directed in the same direction so as to extend and contract together, as a system, either clockwise or counterclockwise in erecting or lowering said working member, and wherein said fluid pressure operated telescopic members are located exteriorly of said pantograph on said support base, said first and second transverse guide means having ends which abut against a side of said first and second longitudinal guide means.

2. A scaffold device comprising a rectangular working member, a rectangular support base disposed below said working member, first and second longitudinal guide means adjacent respective sides of said base, first and second transverse guide means adjacent respective ends of said support base, first and second longitudinally operable pantographs pivotally connected between said base and said working member and having first longitudinal leg portions with lower ends pivoted to said base adjacent respective ends of said base and opposite second longitudinal leg portions movable in respective first and second longitudinal guide means, said first and second leg portions being movable longitudinally together to erect said pantograph with said working member and longitudinally apart to lower said pantograph and said working member in respect to said support base, first and second transversely operable pantographs pivotally connected between said working member and said support member and having first transverse leg portions with lower ends pivoted to said base adjacent respective sides of said base and opposite second transverse leg portions movable in respect to first and second transverse guide means, first and second fluid pressure operated longitudinally extendible piston and cylinder means connected between said support base and said second leg portions of respective longitudinally operable first and second pantographs, first and second fluid pressure operated transversely movable piston and cylinder means connected between said support base and said second leg portions of respective transversely operable first and second pantographs, and substantially upright fluid pressure operated telescopic members mounted on said base and being extensible above said base to lift said working member a predetermined initial amount into a position at which all of said piston and cylinder means engage their respective pantograph leg portions so that they are oriented at an angle in respect to the support base above the horizontal, wherein said first and second longitudinally operable pantographs and said first and second transversely operable pantographs are respectively opposed to each other on diagonals below said working member, wherein said first and second longitudinally operable pantographs and said first and second transversely operable pantographs are contiguously arrange with said second longitudinal leg portions movable in an area adjacent said first transverse leg portions and said second transverse leg portions movable in an area adjacent said first longitudinal portions, and wherein said fluid pressure operated telescopic members are located exteriorly of said pantograph on said support base, said first and second transverse guide means having ends which abut against a side of said first and second longitudinal guide means.

3. A scaffold device according to claim 2, wherein said first and second fluid pressure operated longitudinal movable piston and cylinder means and said first and second fluid pressure operated transversely movable piston and cylinder means comprise separate pistons and cylinders which are initially disposed in a compacted position substantially horizontally adjacent said support base and which are shifted to an inclined position extending upwardly from said support base after said support base has been lifted by said upright fluid pressure operated telescopic members.

4. A scaffold device according to claim 2, wherein said substantially upright fluid pressure operated telescopic members comprise telescopic members adjacent each corner of said support base.

* * * * *